US008820417B2

(12) United States Patent
Reid

(10) Patent No.: US 8,820,417 B2
(45) Date of Patent: Sep. 2, 2014

(54) CENTRALISER

(75) Inventor: Steve Reid, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 245 days.

(21) Appl. No.: 12/933,053

(22) PCT Filed: Mar. 18, 2009

(86) PCT No.: PCT/GB2009/000730
§ 371 (c)(1),
(2), (4) Date: Sep. 21, 2010

(87) PCT Pub. No.: WO2009/115802
PCT Pub. Date: Sep. 24, 2009

(65) Prior Publication Data

US 2011/0005776 A1 Jan. 13, 2011

(30) Foreign Application Priority Data

Mar. 18, 2008 (GB) ..... 0804961.1

(51) Int. Cl.
*E21B 17/10* (2006.01)

(52) U.S. Cl.
USPC ..... 166/381; 166/241.7; 166/215; 175/230; 175/423

(58) Field of Classification Search
USPC ..... 166/381, 241.1, 241.7, 255.2, 382, 213, 166/215; 175/230, 325.3, 423
See application file for complete search history.

(56) References Cited

U.S. PATENT DOCUMENTS

| | | | |
|---|---|---|---|
| 643,358 | A | 2/1900 | Konold |
| 2,009,322 | A | 7/1935 | Emil |
| 2,181,748 | A | 11/1939 | Thaheld |
| 2,498,791 | A | 2/1950 | Clark |
| 2,546,377 | A | 3/1951 | Turechek |
| 2,738,018 | A | 3/1956 | Lynes |
| 2,832,418 | A | 4/1958 | Baker |
| 3,066,738 | A | 12/1962 | Myers |
| 3,087,552 | A | 4/1963 | Graham |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

PCT/GB2005/001391, Int'l Prelim. Report on Patentability, Jun. 23, 2005.

(Continued)

*Primary Examiner* — Cathleen Hutchins
(74) *Attorney, Agent, or Firm* — Wong, Cabello, Lutsch, Rutherford & Brucculeri LLP

(57) ABSTRACT

A centraliser (10) for centralising a tubular (12) within a conduit is described. The centraliser comprises a centraliser body, at least one finger (14) pivotally mounted to the body and at least one collar (20), the/each collar being moveable with respect to the at least one finger. Relative movement between the/each collar and the body pivots the at least one finger from a run-in configuration to an extended configuration.

53 Claims, 4 Drawing Sheets

(56) References Cited

U.S. PATENT DOCUMENTS

| | | | | | |
|---|---|---|---|---|---|
| 3,167,127 | A | | 1/1965 | Sizer | |
| 3,167,128 | A | | 1/1965 | Sutliff | |
| 3,283,821 | A | | 11/1966 | Brown | |
| 3,342,268 | A | | 9/1967 | Brown | |
| 3,371,716 | A | | 3/1968 | Current | |
| 3,482,889 | A | | 12/1969 | Cochran | |
| 3,570,603 | A | * | 3/1971 | Kammerer et al. | 166/290 |
| 3,572,450 | A | * | 3/1971 | Thompson | 175/76 |
| 3,623,551 | A | | 11/1971 | Randermann | |
| 3,722,588 | A | | 3/1973 | Tamplen | |
| 3,729,170 | A | | 4/1973 | Lewis | |
| 3,889,750 | A | | 6/1975 | Mullins | |
| 4,046,405 | A | | 9/1977 | Bonds | |
| 4,127,168 | A | | 11/1978 | Hanson | |
| 4,317,485 | A | | 3/1982 | Ross | |
| 4,331,315 | A | | 5/1982 | Geisow | |
| 4,346,919 | A | | 8/1982 | Morrill | |
| 4,375,240 | A | | 3/1983 | Baugh | |
| 4,473,125 | A | * | 9/1984 | Addudle et al. | 175/426 |
| 4,588,030 | A | | 5/1986 | Blizzard | |
| 4,917,187 | A | | 4/1990 | Burns | |
| 2,230,447 | A | | 2/1991 | Bassinger | |
| 5,058,684 | A | | 10/1991 | Winslow | |
| 5,095,978 | A | | 3/1992 | Akkerman | |
| 5,261,488 | A | | 11/1993 | Gullet | |
| 5,542,473 | A | | 8/1996 | Pringle | |
| 6,062,309 | A | | 5/2000 | Gosse | |
| 6,315,041 | B1 | | 11/2001 | Carlisle | |
| 7,690,424 | B2 | | 4/2010 | McLeod | |
| 2003/0000607 | A1 | | 1/2003 | Jenner | |
| 2003/0173076 | A1 | * | 9/2003 | Sheiretov et al. | 166/241.1 |
| 2004/0055757 | A1 | | 3/2004 | Beall | |
| 2005/0224227 | A1 | | 10/2005 | Hendrie | |
| 2009/0308592 | A1 | | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO 02/42672 | 5/2002 |
| WO | WO 2005/026494 | 3/2005 |
| WO | WO 2005/121498 | 12/2005 |
| WO | WO 2006/046075 | 5/2006 |
| WO | WO 2007/109878 | 10/2007 |

OTHER PUBLICATIONS

PCT/GB2005/001391, International Search Report, Jun. 23, 2005.
PCT/GB2005/001391, Written Opinion, Jun. 23, 2005.
PCT/GB2005/004200, Written Opinion, Apr. 10, 2006.
PCT/GB2005/004200, Int'l Prelim. Report on Patentability, May 1, 2007.
PCT/GB2005/004200, International Search Report, Jan. 11, 2006.
PCT/GB2005/003871, Int'l Prelim. Report on Patentability, Sep. 11, 2007.
PCT/GB2005/003871, International Search Report, Nov. 17, 2005.
Office Action, Applicant's co-pending U.S. Appl. No. 11/816,421, Mar. 30, 2009.
Office Action, Applicant's co-pending U.S. Appl. No. 11/816,421, Sep. 28, 2009.
Foreign Office Action (UL) dated Nov. 1, 2005 (U.S. Appl. No. 11/816,421 is §371 of same UK app.).
PCT/GB2005/003871, Written Opinion, Nov. 22, 2005.
PCT/GB2006/001297, Int'l Prelim. Report on Patentability and Written Opinion, Oct. 9, 2007.
PCT/GB2006/001297, International Search Report, Oct. 9, 2007.
Office Action, Applicant's co-pending U.S. Appl. No. 11/909,820, May 29, 2009.
Office Action, Applicant's co-pending U.S. Appl. No. 11/909,820, Feb. 19, 2010.
PCT/GB2007/001040, International Search Report, Jun. 5, 2010.
PCT/GB2007/001040, Int'l Prelim. Report on Patentability and Written Opinion, Sep. 23, 2008.
PCT/GB2007/004372, Int'l Prelim. Report on Patentability and Written Opinion, May 19, 2009.
PCT/GB2007/004372, International Search Report, Jan. 23, 2008.
PCT/GB2008/002042, Int'l Prelim. Report on Patentability and Written Opinion, Dec. 20, 2009.
PCT/GB2008/002042, International Search Report, Oct. 17, 2008.
PCT/GB2009/071874, Int'l Prelim. Report on Patentability and Written Opinion, Jun. 8, 2010.
PCT/GB2009/071874, International Search Report, Jul. 23, 2009.
PCT/GB2008/003883, Int'l Prelim. Report on Patentability and Written Opinion, May 25, 2010.
PCT/GB2008/003883, International Search Report, Mar. 26, 2009.
PCT/GB2009/0004830, Int'l Prelim. Report on Patentability and Written Opinion, Aug. 24, 2010.
PCT/GB2009/0004830, International Search Report, Sep. 28, 2009.
Office Action, Applicant's co-pending U.S. Appl. No. 11/577,866, Aug. 25, 2010.
International Search Report for PCT/GB2009/000730, Sep. 24, 2009.
Written Opinion for PCT/GB2009/000730, Sep. 18, 2010.
Office Action, Applicant's co-pending U.S. Appl. No. 11/909,820, Oct. 7, 2010.
International Search Report for PCT/GB2009/000770, Oct. 8, 2009.
Written Opinion for PCT/GB2009/000770, Sep. 29, 2010.

* cited by examiner

CENTRALISER

FIELD OF THE INVENTION

The present invention relates to a centraliser for centralising a tubular within a conduit. Particularly, but not exclusively, the centraliser is for centralising a tubular within a deviated conduit.

BACKGROUND TO THE INVENTION

Centralisers are widely used within the hydrocarbon extraction industry to centraliser a tubular within a wellbore. It may be necessary to centralise a tubular to allow the passage of services, such as hydraulic lines or electrical cables, in the annulus between the tubular and the wellbore, or to ensure that cement flows around the entire perimeter of the tubular during a cementing operation in which cement is pumped into the annulus.

Several types of centraliser, such as bow spring centralisers, are known. However, conventional centralisers tend to have limited load bearing capacity and, for example, in a deviated well where the tubular may lie at an angle to the vertical, to centralise the tubular, the centraliser has to bear some of the weight of the tubular. If the centraliser does not centralise a tubular effectively in this situation then, for example in a cementing operation, the cement may not be able to flow fully around and encase the tubular.

SUMMARY OF THE INVENTION

According to a first aspect of the present invention there is provided a centraliser for centralising a tubular within a conduit, the centraliser comprising:

a centraliser body;

at least one finger pivotally mounted to the body; and at least one collar, the/each collar being movable with respect to the at least one finger;

wherein relative movement between the/each collar and the body pivots the at least one finger from a run-in configuration to an extended configuration.

In one embodiment, the present invention provides a centraliser in which fingers are used to centralise a tubular within a conduit, such as casing, lining or open hole. As the fingers are moved to the extended configuration, they engage and press against the conduit wall, moving the tubular towards the centre of the conduit.

Preferably, the at least one collar is moveably connected to the/each finger.

Preferably, relative movement which brings the/each collar and body towards each other, pivots the/each finger from the run-in configuration to the extended configuration.

Additionally, relative movement which moves the/each collar and body apart may pivot the/each finger from the extended configuration to the run-in configuration.

The body may be fixed relative to the/each finger.

In a preferred embodiment, to pivot the/each finger from the run-in configuration to the extended configuration, the/each collar moves towards the body.

In a preferred embodiment, to pivot the/each finger from the extended configuration to the run-in configuration, the/each collar moves away from the body.

In a preferred embodiment there are a plurality of fingers.

The/each collar may be moveably connected to the/each finger by means of at least one lug moving with at least one track. A track and lug arrangement allows for the setting of the fingers to be achieved in a controlled and predictable manner.

In one embodiment, each finger defines at least one track, each track engaged with a lug defined by one of said collars.

In this embodiment, each finger may define two tracks.

In an alternative embodiment, the/each collar defines a plurality of tracks, at least one track being associated with each finger, each track engaged with a lug defined by a finger.

In this embodiment, each finger may define two lugs, each lug engaged with a track defined by one of said collars.

Each lug may continuously engage the track with which it is engaged. By continuously it is meant each lug engages a track at the run-in configuration and the extended configuration and all configurations therebetween.

In one embodiment, the engagement between the lugs and tracks retains each finger in the run-in configuration. As the lug engages the track in a run-in configuration, the fingers can be retained in the run-in configuration to prevent setting occurring inadvertently.

Alternatively each lug may engage the track only in the run-in configuration.

In one embodiment, the engagement between the lugs and tracks assists the pivoting of the fingers from the extended to the run-in configuration. The engagement between the lugs and tracks can be used to pull the fingers from the extended to the run-in configuration ensuring predictable and controlled de-setting of the centraliser, if required.

The collar may define at least one finger engaging surface adapted to engage an underside of each finger. A finger engaging surface can, in one embodiment, act as a wedge to maintain a finger in the run-in configuration.

Preferably, engagement of the/each finger engaging surface and the underside of the/each finger assists in pivoting the fingers from the run-in to the extended configuration.

Preferably, the/each finger is hingedly mounted to the body.

In one embodiment, the/each finger is mounted to the body by means of a hinge pin.

Preferably, the/each hinge pin is captively received by the body.

Preferably, the/each finger defines a hemicylindrical end.

Preferably, the/each hemicylindrical end is received within a hemicylindrical socket defined by the body. The use of a hemicylindrical end and a hemicylindrical socket assists in the transfer of load from the fingers to the centraliser body.

Preferably, the/each finger defines a conduit engaging surface.

Preferably, each conduit engaging surface is at an end of the finger opposite the hemispherical end.

Each conduit engaging surface may include a smooth portion to assist, in use, the finger sliding across the conduit surface.

Each conduit engaging surface may include a rough portion adapted, in use, to grip the conduit surface. Such an arrangement permits the centraliser fingers to be used as slips.

The rough portion may define serrations.

In one embodiment, the centraliser is set by exposure to well pressure.

In this embodiment, pistons may be provided to provide relative movement between the/each collar and the body. The pistons may be activated by exposure to hydrostatic pressure in the well.

The centraliser may further comprise at least one locking device to lock the centraliser in the extended configuration.

The/each locking device may prevent the centraliser fingers from moving from the extended configuration to the run-in configuration.

The/each locking device may be adapted to lock the/each collar relative to the body portion.

The/each locking device may be a uni-directional device in that it permits movement in a first direction but not in a second direction, opposite the first direction.

The/each locking device may be a ratchet.

The centraliser may comprise at least one retaining device for releasably retaining the centraliser in the run-in configuration. A retaining device prevents the centraliser from setting inadvertently.

In one embodiment there are two sets of centraliser fingers and two collars, one collar associated with each set of centraliser fingers.

In this embodiment the fingers of one set may pivot in a first direction with respect to the centraliser body and the fingers of the other set may pivot in a second direction with respect to the centraliser body, the second direction being opposite to the first direction. Such an arrangement permits both sets of fingers to be set by a single actuator.

Preferably the/each collar applies a setting pressure to the fingers to move the fingers from the run-in configuration to the extended configuration.

According to a second aspect of the present invention, there is provided a method of centralising a tubular within a conduit, the method comprising:

providing a centraliser connected to a tubular within a wellbore;

causing relative movement between at least one centraliser collar and a centraliser body to pivot at least one centraliser finger from a run-in configuration to an extended configuration, the/each finger engaging the conduit during movement from the run-in configuration to the extended configuration to move the tubular towards a central location within the conduit.

BRIEF DESCRIPTION OF THE DRAWINGS

Embodiments of the present invention will now be described with reference to the accompanying drawings in which.

DETAILED DESCRIPTION OF THE DRAWINGS

Figure 1:
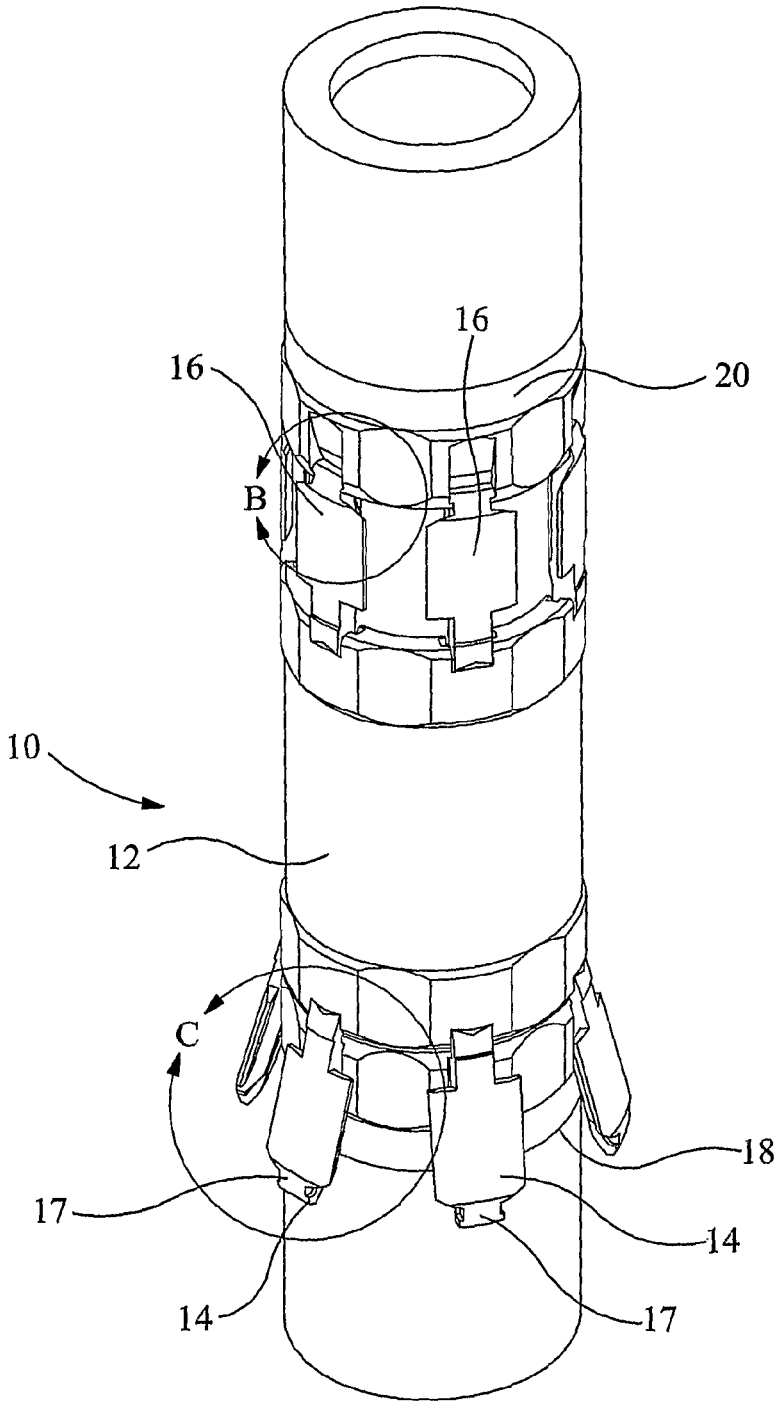
FIG. 1 is a perspective view of a centraliser according to an embodiment of the present invention.

Referring firstly to FIG. 1, there is shown a perspective view of a centraliser 10, according to an embodiment of the present invention. The centraliser 10 comprises a centraliser body 12, a first set of six centraliser fingers 14 and a second set of six centraliser fingers 16, each finger 14,16 being pivotally mounted to the body 16. The centraliser 10 further comprises a first collar 18 moveably connected to the first set of fingers 14 and a second collar 20 moveably connected to the second set of fingers 16.

Relative movement of the collars 18,20 towards the body 12 applies a setting pressure to the fingers 14,16 and pivots the fingers 14,16 from a run-in configuration to an extended configuration. As can be seen from FIG. 1, the first set of centraliser fingers 14 are in the extended configuration, in which the first set of fingers 14 are splayed radially outwards for engagement with a conduit wall W (see FIG. 2), and the second set of centraliser fingers 16 are in the run-in configuration, in which the second set of fingers 16 define a minimum diameter permitting the centraliser 10 to be deployed in the wellbore.

In the extended configuration, each finger 14,16 contacts the conduit wall W. In particular a wall engaging surface 17 defined by each finger 14,16 contacts the wall W. If the tubular is off-centre in the conduit C (see FIG. 2), one or two of these fingers 14,16 will engage the wall W first and apply a push force, equal to the setting pressure applied by the collars 18,20, to the conduit wall W, pushing the tubular away from the wall W.

It will be noted from FIG. 1 that the first and second set of centraliser fingers 14,16 face in opposite directions. Such an arrangement facilitates the setting of the fingers 14,16 as the fingers 14,16 can be set by a single actuator applying a push and pull to set both sets. It is preferred that during setting, the collars 18,20 move towards the body 12 and fingers 14,16 as this permits the wall engaging surface 17 to slide on the conduit wall W. If the fingers 14,16 were pushed over the collars 18,20 the tips of the fingers 14,16 digging into softer conduit wall surfaces, requiring greater setting force to be applied.

Figure 2:
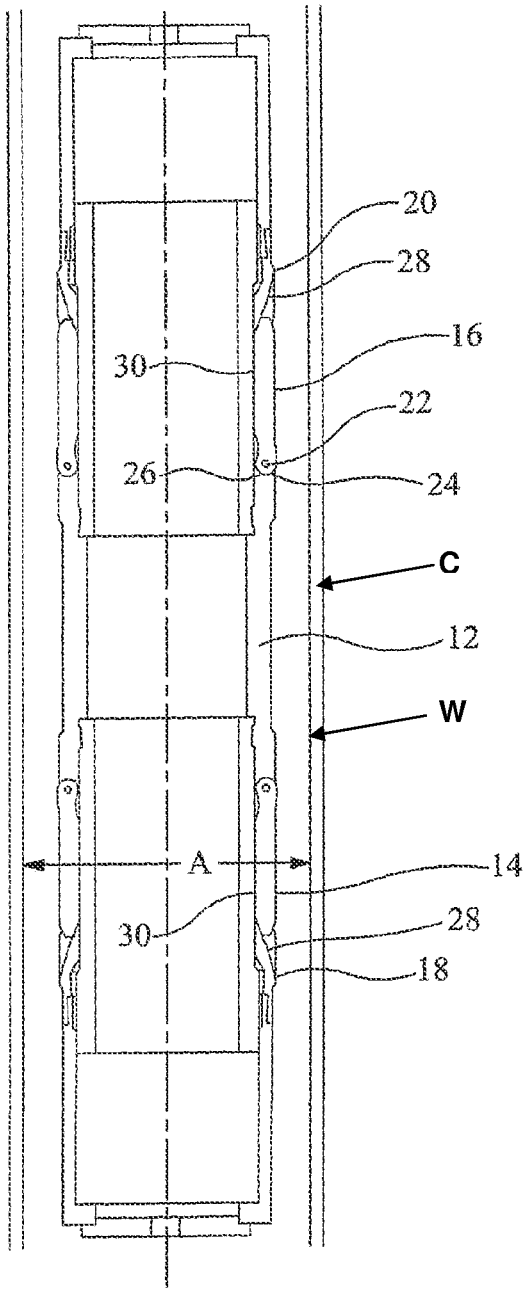
FIG. 2 is a section view of the centraliser of FIG. 1.

Referring to FIG. 2, each finger 14,16 is connected to the body 12 by a hinge pin 22. In addition, each finger 14,16 defining a hemispherical end 24 that is received in a hemispherical socket 26 defined by the body 12.

It can also be seen from FIG. 2 that the collars 18,20 each define six wedge surfaces 28 adapted to slide underneath and engage an underside surface 30 of the fingers 14,16 to assist in moving the fingers 14,16 from the run-in configuration to the set configuration. In the set configuration the wedge surface 28 assists in maintaining the fingers 14,16 in contact with the conduit wall W.

Figure 3:
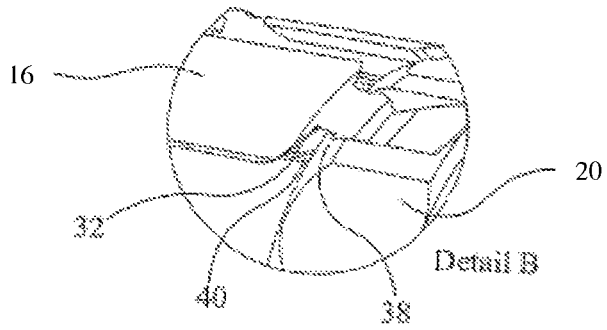
FIG. 3 is an enlarged view of detail B of FIG. 1.
Figure 4:
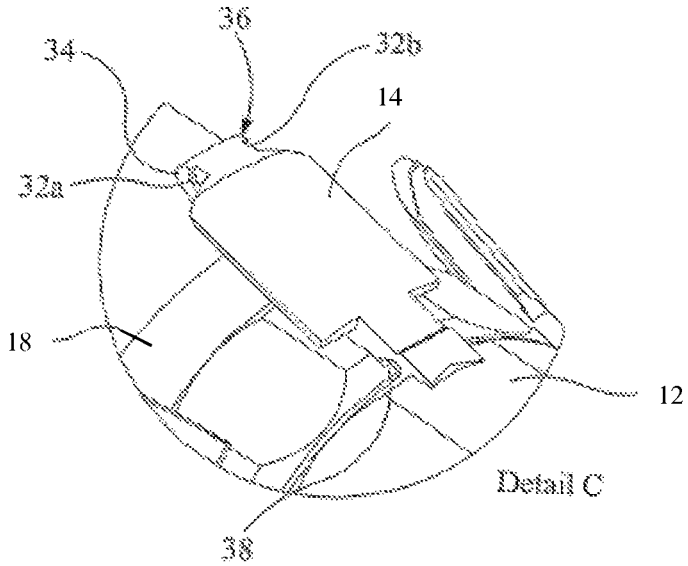
FIG. 4 is an enlarged view of detail C of FIG. 1.

Referring to FIGS. 3 and 4, it can be seen that each finger further 14,16 defines a first and second track 32*a*,32*b*, the tracks 32*a*,32*b* being defined by a first and second finger edge 34,36. Each collar 18,20 defines a number of lugs 38, one lug for each track 32, each lug 38 captured within its respective track 32 continuously from the run-in to the set configurations.

This arrangement has a number of advantages. As can be seen in FIG. 3, the lug 38 engages a track lower edge 40 to retain the finger 14,16 in the run-in configuration. This prevents the centraliser 10 from setting prematurely under the influence of environmental factors.

The second advantage of the lug 38 and track 32 arrangement is apparent during setting of the fingers 14,16. As the fingers 14,16 move from the run-in to the set configurations, the lugs move along the track 32 controlling the rate of deployment of the fingers 14,16, ensuring the deployment occurs predictably. Furthermore, if it is necessary to de-set the centraliser, movement of the collars 18,20 away from the body portion 12 will pull the fingers 14,16 back to the run-in configuration through the interaction to the lugs 38 and the track 32.

As already described, the centraliser 10 is set by movement of the collars 18,20 towards the body 12, which applies a setting pressure to the fingers 14,16. This setting pressure and movement of the collars 18,20 can be achieved in a number of ways, including, for example, applying a pressure from surface or providing pistons which when exposed to well pressure, drive the collars 18,20 towards the centraliser body 12.

Figure 5:
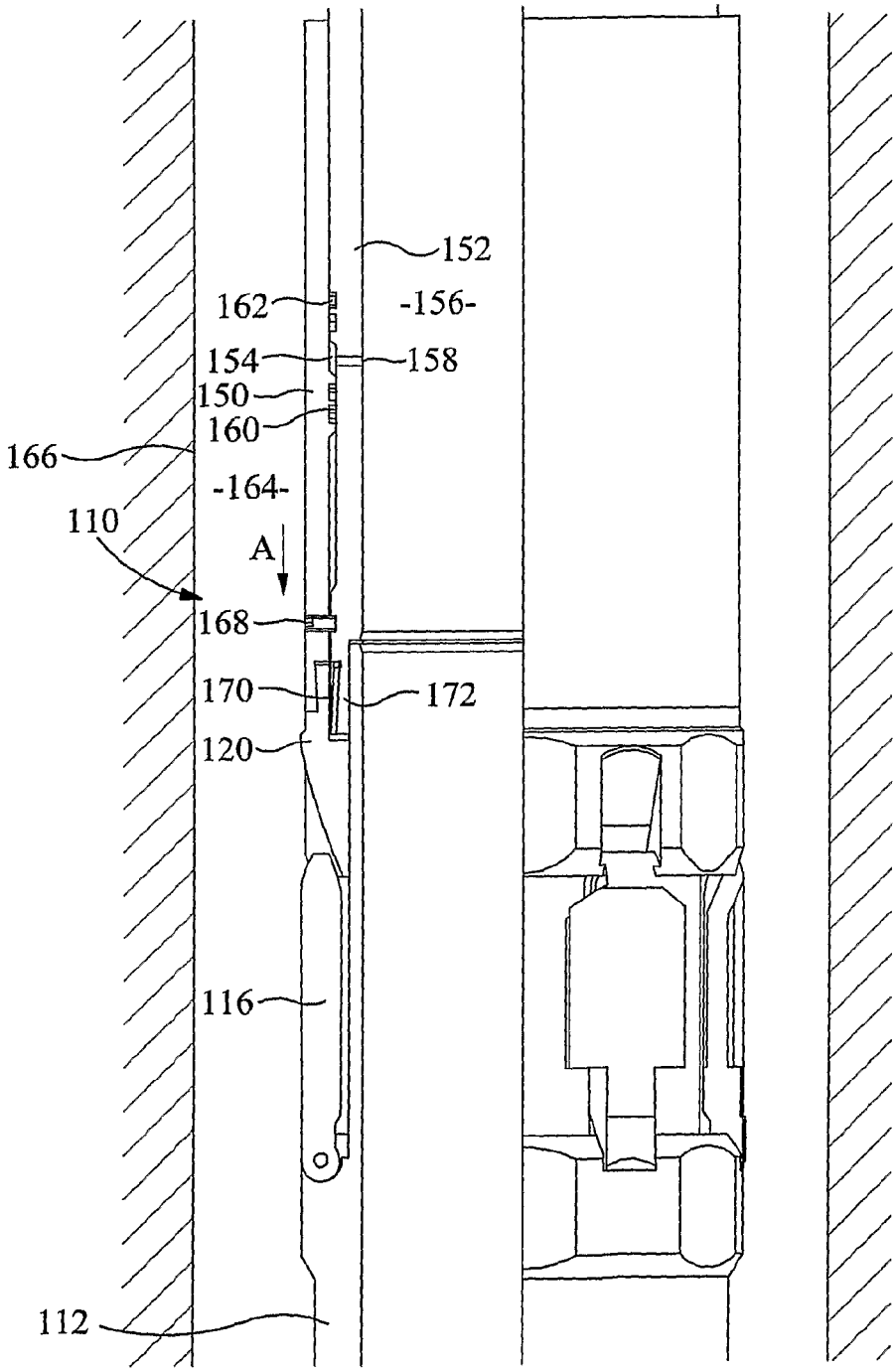
FIG. 5 is a partial section view of part of a centraliser according to a second embodiment of the present invention.

A piston driving arrangement is shown in FIG. 5, a partial section view of part of a centraliser 110, according to a second embodiment of the present invention.

FIG. 5 shows part of the centraliser body 112, the second set of fingers 116 and the second collar 120. It will be understood that the first collar and the first set of fingers are arranged with respect to the second collar 120 and the second set of fingers 116 in a similar way to the embodiment described in FIGS. 1 to 4.

The second collar 120 is attached to a sleeve 150 which is adapted to slide along a mandrel 152. The sleeve 150 is initially pinned to the mandrel 152 by means of a number of shear screws 168. The sleeve 150 and the mandrel 152 are arranged to define a void 154 therebetween which is in fluid communication with a mandrel throughbore 156 via a port 158. The void 154 is sealed by two pairs of annular seals 160,162 such that when the mandrel throughbore 156 is at a given pressure, the void 154 is at the same pressure.

If the pressure in the void 154 is greater than the pressure in an annulus 164 defined between the centraliser 110 and the wellbore wall 166, the sleeve 150 moves in the direction of arrow A, opening up the void 154 and moving the centraliser collar 120 beneath the second set of fingers 116, in turn moving the fingers 116 from the run-in configuration to the set configuration. The shear screws 168 serve to retain the sleeve 150 relative to the mandrel 152 until the pressure in the void 154 is sufficiently high to shear the screws 168.

The collar 120 also defines a toothed profile 170 which engages a toothed mandrel profile 172. The engagement between the toothed profiles 170,172 is such that movement in the direction of arrow A is permitted but movement in the return direction, opposite the direction of arrow A, is prevented. This arrangement locks the collar 120 and the second set of fingers 116 in the run-in configuration.

It will be understood that a similar arrangement can be used to set and lock the first set of fingers.

Various improvements and modifications may be made to the above described embodiment without parting from the scope of the invention. For example, although two sets of fingers are shown as part of the centraliser, multiple sets of fingers could be used or, indeed, multiple centralisers could be used along the length of the tubular. In addition, although six fingers are described for each set, more or less than six may provide utility.

The invention claimed is:

1. A centraliser for centralising a tubular within a conduit, the centraliser comprising:

a body;

at least one finger pivotally mounted to the body at or adjacent to a first end of the at least one finger; and at least one collar being moveable with respect to the at least one finger, wherein the at least one finger defines a conduit engaging surface at a second end of the at least one finger opposite to the first end of the at least one finger, wherein the at least one finger defines at least one track and the at least one collar defines at least one lug which engages said at least one track, or the at least one collar defines at least one track and the at least one finger defines at least one lug which engages said at least one track, wherein the at least one collar is moveably connected to the at least one finger by means of the at least one lug moving in the at least one track, and wherein relative movement between the at least one collar and the body causes the at least one lug to move in the at least one track so as to pivot the at least one finger relative to the body from a run-in configuration to an extended configuration, and said at least one finger extends outwardly no further than an outer surface of the body or an outer surface of the at least one collar when the at least one finger is in the run-in configuration.

2. The centraliser of claim 1, wherein relative movement which brings the at least one collar and body towards each other, pivots the at least one finger from the run-in configuration to the extended configuration.

3. The centraliser of claim 1, wherein relative movement which moves the at least one collar and body apart pivots the at least one finger from the extended configuration to the run-in configuration.

4. The centraliser of claim 1, wherein the body is fixed relative to the at least one finger.

5. The centraliser of claim 1, wherein to pivot the at least one finger from the run-in configuration to the extended configuration, the at least one collar moves towards the body.

6. The centraliser of claim 1, wherein to pivot the at least one finger from the extended configuration to the run-in configuration, the at least one collar moves away from the body.

7. The centraliser of claim 1, wherein there are a plurality of fingers.

8. The centraliser of claim 1, wherein said at least one finger defines the at least one track and said at least one collar defines the at least one lug.

9. The centraliser of claim 8, wherein said at least one finger defines two tracks.

10. The centraliser of claim 8, wherein said at least one lug continuously engages the track with which said at least one lug is engaged.

11. The centraliser of claim 8, wherein the engagement between the at least one lug and the at least one track retains each finger in the run-in configuration.

12. The centraliser of claim 8, wherein the at least one lug engages the at least one track only in the run-in configuration.

13. The centraliser of claim 8, wherein the engagement between the at least one lug and the least one track assists the pivoting of the at least one finger from the extended to the run-in configuration.

14. The centraliser of claim 1, wherein the at least one collar defines a plurality of said tracks, at least one of said tracks being associated with at least one of the at least one fingers, each track engaged with a lug defined by said at least one finger.

15. The centraliser of claim 14, wherein said at least one finger defines two lugs, each of the lugs engaged with a track of at the at least one tracks defined by said at least one collar.

16. The centraliser of claim 14, wherein each lug continuously engages the track with which the lug is engaged.

17. The centraliser of claim 14, wherein the engagement between the lugs and tracks retains each finger in the run-in configuration.

18. The centraliser of claim 14, wherein each lug engages the track only in the run-in configuration.

19. The centraliser of claim 14, wherein the engagement between the lugs and tracks assists the pivoting of the fingers from the extended to the run-in configuration.

20. The centraliser of claim 1, wherein said at least one finger comprises an underside opposite the conduit engaging surface, and said at least one collar defines at least one finger engaging surface adapted to engage the underside of said at least one finger.

21. The centraliser of claim 20, wherein engagement of the at least one finger engaging surface and the underside of the at least one finger assists in pivoting the fingers from the run-in to the extended configuration.

22. The centraliser of claim 1, wherein the at least one finger is hingedly mounted to the body.

23. The centraliser of claim 22, wherein the at least one finger is mounted to the body by means of a hinge pin.

24. The centraliser of claim 23, wherein the at least one hinge pin is captively received by the body.

25. The centraliser of claim 1, wherein each finger defines a hemicylindrical end.

26. The centraliser of claim 25, wherein, the at least one hemicylindrical end is received within a hemicylindrical socket defined by the body.

27. The centraliser of claim 25, wherein the at least one conduit engaging surface is at an end of the finger opposite the hemicylindrical end.

28. The centraliser of claim 1, wherein the at least one conduit engaging surface includes a smooth portion to assist, in use, the finger sliding across the conduit surface.

29. The centraliser of claim 1, wherein each conduit engaging surface includes a rough portion adapted, in use, to grip the conduit surface.

30. The centraliser of claim 29, wherein the rough portion defines serrations.

31. The centraliser of claim 1, wherein the centraliser is set by exposure to well pressure.

32. The centraliser of claim 1, wherein at least one piston is provided to provide relative movement between the at least one collar and the body.

33. The centraliser of claim 32, wherein said at least one piston is activated by exposure to hydrostatic pressure in the well.

34. The centraliser of claim 1, wherein the centraliser further comprises at least one locking device to lock the centraliser in the extended configuration.

35. The centraliser of claim 34, wherein the at least one locking device prevents the centraliser fingers from moving from the extended configuration to the run-in configuration.

36. The centraliser of claim 34, wherein the at least one locking device is adapted to lock the at least one collar relative to the body.

37. The centraliser of claim 34, wherein the at least one locking device is a uni-directional device in that it permits movement in a first direction but not in a second direction, opposite the first direction.

38. The centraliser of claim 34, wherein the at least one locking device is a ratchet.

39. The centraliser of claim 1, wherein the centraliser may comprise at least one retaining device for releasably retaining the centraliser in the run-in configuration.

40. The centraliser of claim 1, comprising two sets of centraliser fingers and two collars, each collar associated with a different set of centraliser fingers.

41. The centraliser of claim 40, wherein the fingers of one set of centraliser fingers pivot with respect to the centraliser body when the corresponding collar is moved in a first axial direction and the fingers of the other set of centraliser fingers pivot with respect to the centraliser body when the corresponding collar is moved in a second axial direction, the second axial direction being opposite to the first axial direction.

42. The centraliser of claim 40, wherein the at least one collar applies a setting pressure to the fingers to move the fingers from the run-in configuration to the extended configuration.

43. The centraliser of claim 1, wherein said at least one finger is located inwardly of an outermost surface of the body and/or which is located inwardly of an outermost surface of the at least one collar when the at least one finger is in the run-in configuration.

44. The centraliser of claim 1, wherein said at least one finger defines a surface is substantially flush with an outermost surface of the body and/or which is substantially flush with an outermost surface of the at least one collar when the at least one fingers is in the run-in configuration.

45. A method of centralising a tubular within a conduit, the method comprising:

providing a centraliser connected to a tubular, the centraliser comprising:

a body;

at least one finger pivotally mounted to the body at or adjacent to a first end of the at least one finger; and at least one collar being moveable with respect to the at least one finger, wherein the at least one finger defines a conduit engaging surface at a second end of the at least one finger opposite to the first end of the at least one finger, and wherein the at least one finger defines at least one track and the at least one collar defines at least one lug which engages said at least one track, or the at least one collar defines at least one track and the at least one finger defines at least one lug which engages said at least one track, and the method further comprising:

running the centraliser and the tubular into a conduit with the at least one finger in a run-in configuration in which said at least one finger extends outwardly no further than an outwardly directed surface of the body and no further than an outwardly directed surface of the at least one collar; and causing relative movement between the at least one collar and the body to cause the at least one lug to move in the at least one track so as to pivot the at least one finger relative to the body from the run-in configuration to an extended configuration in which the conduit engaging surface of the at least one finger engages the conduit.

46. The method of claim 45, wherein the conduit comprises a wellbore.

47. A centraliser for centralising a tubular within a conduit, the centraliser comprising:

a body;

at least one finger pivotally mounted to the body at or adjacent to a first end of the at least one finger; and at least one collar being moveable with respect to the at least one finger, wherein the at least one finger defines a conduit engaging surface at a second end of the at least one finger opposite to the first end of the at least one finger, wherein the at least one finger defines at least one track and the at least one collar defines at least one lug which engages said at least one track, or the at least one collar defines at least one track and the at least one finger defines at least one lug which engages said at least one track, wherein the at least one collar is moveably connected to the at least one finger by means of the at least one lug moving in the at least one track, and wherein relative movement between the at least one collar and the body causes the at least one lug to move in the at least one track so as to pivots the at least one finger relative to the body from a run-in configuration to an extended configuration, the centraliser body and the at least one collar together define a recess, and the at least one finger is wholly located within the recess when the at least one finger is in the run-in configuration.

48. A centraliser for centralising a tubular within a conduit, the centraliser comprising:

a body defining at least one hemicylindrical socket;

at least one finger defining a hemicylindrical end which is received within one of the at least one hemicylindrical sockets, the at least one finger being pivotally mounted to the body at a position adjacent to the hemicylindrical end; and at least one collar being moveable with respect to the at least one finger, wherein the at least one finger defines a conduit engaging surface at an end of the at least one finger opposite to the hemicylindrical end, wherein the at least one finger defines at least one track and the at least one collar defines at least one lug which engages said at least one track, or the at least one collar defines at least one track and the at least one finger defines at least one lug which engages said at least one track, and wherein the at least one collar is moveably connected to the at least one finger by means of the at least one lug moving in the at least one track, and wherein relative movement between the at least one collar and the body causes the at least one lug to move in the at least one track so as to pivots the at least one finger relative to the body from a run-in configuration to an extended configuration.

49. The centraliser of claim 48, wherein the at least one finger is mounted to the body by means of a hinge pin.

50. The centraliser of claim 49, wherein the at least one hinge pin is captively received by the body.

51. A centraliser for centralising a tubular within a conduit, the centraliser comprising:

a centraliser body;

at least one finger pivotally mounted to the body; and at least one collar being moveable with respect to the at least one finger, wherein the at least one collar is moveably connected to the at least one finger by means of at least one lug moving in at least one track, relative movement between the at least one collar and the body pivots the at least one finger from a run-in configuration to an extended configuration, and said at least one finger extends outwardly no further than an outer surface of the body or an outer surface of the at least one collar when the at least one finger is in the run-in configuration, and wherein the at least one collar defines a plurality of said tracks, at least one of said tracks being associated with at least one of said at least one fingers, each track engaged with a lug defined by at least one of said at least one fingers.

52. The centraliser of claim 51, wherein said at least one finger defines two lugs, each of the lugs engaged with a track of said at least one track defined by said at least one collar.

53. A centraliser for centralising a tubular within a conduit, the centraliser comprising:

a centraliser body;

at least one finger pivotally mounted to the body; and at least one collar being moveable with respect to the at least one finger, wherein the at least one collar is moveably connected to the at least one finger by means of at least one lug moving in at least one track, relative movement between the at least one collar and the body pivots the at least one finger from a run-in configuration to an extended configuration, and said at least one finger extends outwardly no further than an outer surface of the body or an outer surface of the at least one collar when the at least one finger is in the run-in configuration, and the centraliser further comprising at least one locking device to lock the centraliser in the extended configuration, wherein the at least one locking device is a ratchet.

* * * * *